United States Patent [19]

Thomasson

[11] Patent Number: 4,518,090

[45] Date of Patent: May 21, 1985

[54] BOOMS FOR CRANES AND THE LIKE

[75] Inventor: William R. Thomasson, County Durham, England

[73] Assignee: Coles Cranes Limited, Sunderland, England

[21] Appl. No.: 409,222

[22] Filed: Aug. 18, 1982

[30] Foreign Application Priority Data

Aug. 18, 1981 [GB] United Kingdom ..... 8125175

[51] Int. Cl.[3] ..... B66C 23/36

[52] U.S. Cl. ..... 212/189; 212/238; 212/261

[58] Field of Search ..... 212/237, 238, 255, 189, 212/260–270, 182, 242; 308/3 R

[56] References Cited

U.S. PATENT DOCUMENTS

| | | | |
|---|---|---|---|
| 2,502,108 | 3/1950 | Taylor | 212/261 |
| 2,625,276 | 1/1953 | Babare et al. | 212/237 |
| 2,786,582 | 3/1957 | Foster | 212/238 |
| 3,059,785 | 10/1962 | Buckeye | 212/261 |
| 3,317,057 | 5/1967 | Gjelsteen | 212/242 |
| 3,374,909 | 3/1968 | Ferwerda | 212/264 |
| 3,396,852 | 8/1968 | Balogh et al. | 212/238 |
| 3,747,957 | 7/1973 | Noll | 212/182 |
| 3,768,575 | 10/1973 | MacKinnon et al. | 308/3 R |

FOREIGN PATENT DOCUMENTS

| | | | |
|---|---|---|---|
| 553034 | 2/1958 | Canada | 212/261 |
| 2346789 | 4/1974 | Fed. Rep. of Germany | 212/261 |

*Primary Examiner*—Galen L. Barefoot
*Assistant Examiner*—Stephen P. Avila
*Attorney, Agent, or Firm*—Townsend and Townsend

[57] ABSTRACT

A crane or the like (e.g. an access platform or excavator), having a boom wherein the boom is lifted or lowered by one or more hydraulic rams or the like, the or each ram acting on a cradle on which the boom rests and in which it is free to move, the cradle being linked to the platform or the base of the crane or the like, at a point between the foot of the ram(s) and the foot of the boom or at the foot of the boom. This arrangement has the advantage that the boom stresses during lifting are evened out, and expensive accurate machinery of the boom pivot holes are avoided.

11 Claims, 5 Drawing Figures

BOOMS FOR CRANES AND THE LIKE

BACKGROUND OF THE INVENTION

The present invention relates to cranes having hydraulically operated derricking booms.

In such cranes one or more hydraulic rams are normally positioned underneath the boom and are positively connected between the platform or base from which the crane boom pivots and the crane itself. The crane boom has therefore two points of attachment to the platform or base, one point being the ram attachment point and the other being the boom pivot point. During the manufacture of such cranes it is essential if the boom is to work at low angles as is the case in a mobile crane that the machining of the boom pivot holes relative to the derrick ram pivot holes or vice versa is carried out with a very tight tolerance. This is because at low elevations the angle between the derrick rams and boom is very small and very small differences in hole centres can cause large changes in the limiting angles of the boom. Maintaining the tight tolerance required is a costly and time consuming process.

A further problem is that stresses produced in the boom in the area about the ram attachment point are high and fluctuate from tension to compression due to high locally applied loads and moments. Whilst allowance for these stresses presents no particular problem, nevertheless when duty cycle work fatigue are design parameters, the penalties are significant. For example where the stress is an item changes from tension to compression the permissable working load may be only about 60% of that where the stress remains in tension or compression for any given number of working cycles. Similar disadvantages can also occur when the stress changes too rapidly even when only in tension or only in compression.

SUMMARY OF THE INVENTION

A crane or the like apparatus according to the invention comprises a boom lifted or lowered by one or more hydraulic rams, the or each ram acting on a cradle on which the boom rests and in which it is free to move, the boom being pivotally mounted at its foot, the cradle being linked to the platform or base of the crane.

By freely cradling the boom at its lifting point the boom stresses are evened out and the expensive gauging of the pivot to lifting points is eliminated.

A further advantage also results in that when the crane in accordance with the invention is a mobile crane and the boom is so long that a trailer needs to be provided to support the boom head, the derrick lifting ram(s) can be lowered so that the cradle is out of contact with the boom which then ensures that the boom is only supported at its head and foot and thus avoids undue stress and undue wear on hydraulic seals which would otherwise be caused at the derrick lifting point if this was fixed as in known cranes.

Preferably the pivoting of the boom to the crane base or platform is by means of a slot and pin arrangement. Suitably the boom foot is slotted. This enables the mounting of the boom to the crane base to be much simpler and is also advantageous if the boom has to be removed from or replaced on the crane.

In order to measure the load on the boom the cradle can be provided with a compression load cell. Because of the free cradling of the boom, such a load cell will indicate a true boom loading without interference from indeterminate stray parameters caused by friction, stress and so on.

A tension link or links may be pivotally connected between the cradle and platform with the link pivots to the base a platform being located nearer the foot of the boom than the position of the ram pivot to the base and preferably at the boom foot pivot position. When two links are used a derrick arrangement is created by the ram and the two links.

In order to prevent the boom bouncing in the cradle, a holdfast comprising a simple member extending from the cradle and over the boom is preferably provided.

Since the cradling arrangement of the invention remains a lifting arrangement even with the boom removed, the crane without a boom, can be used to lift light loads.

BRIEF DESCRIPTION OF THE DRAWINGS

Embodiments of the invention will now be described by way of example with reference to the drawings in which.

DETAILED DESCRIPTION OF THE PREFERRED EMBODIMENT

Figure 1:
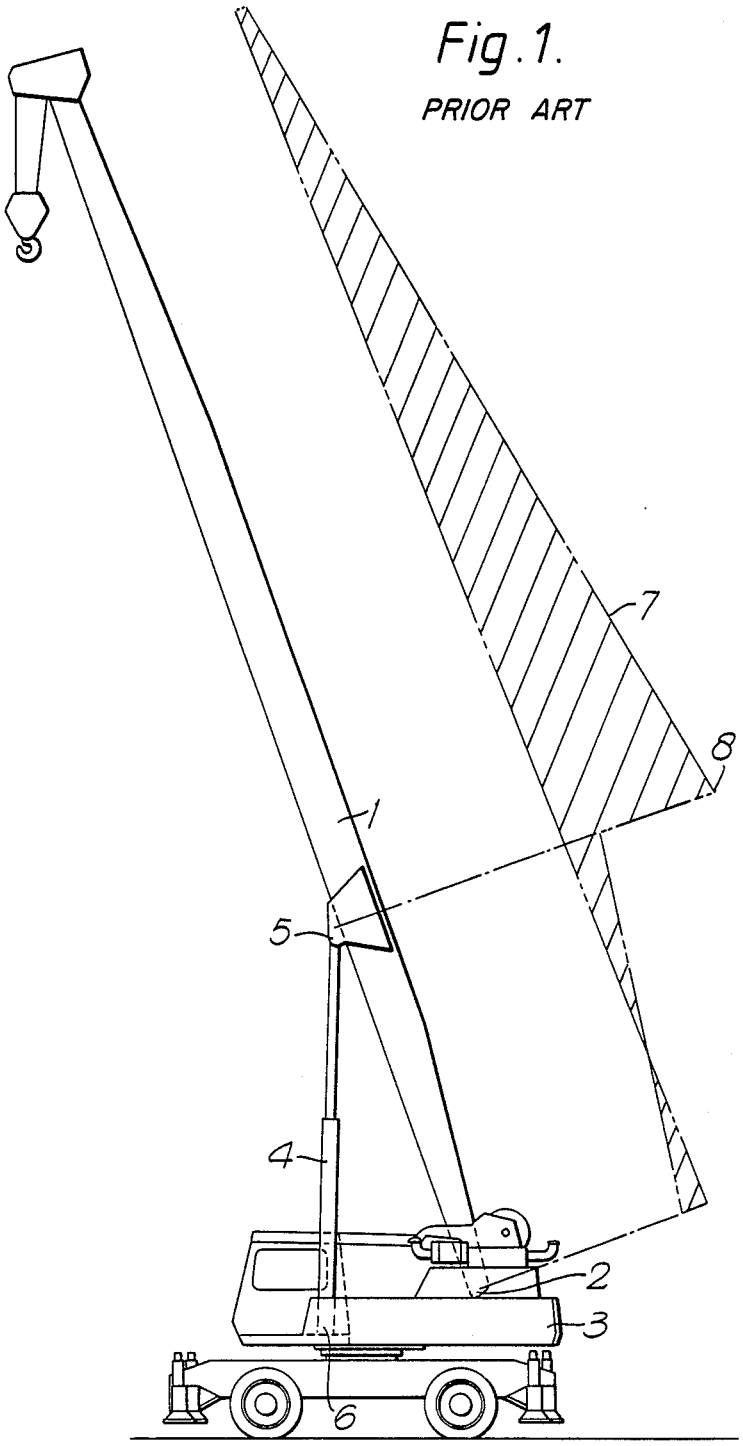
Fig. 1. PRIOR ART
FIG. 1 shows a prior art mobile crane in which the derrick ram is fixed in a known manner to the boom, the figure including an associated boom bending moment diagram.

In FIG. 1 which shows a known type of crane the boom 1 is pivoted at 2 to the rotatable crane platform 3 and the boom is derricked up or down by means of a ram 4 pivotally fixed to the boom 5 and to the crane platform at 6. The boom bending moment is diagrammatically shown at 7 where it can be seen that the bending moment suddenly changes at point 8. As will be later shown and further described with reference to FIG. 4, the bending moment of cranes according to the present invention does not have this sudden change.

Figure 2:
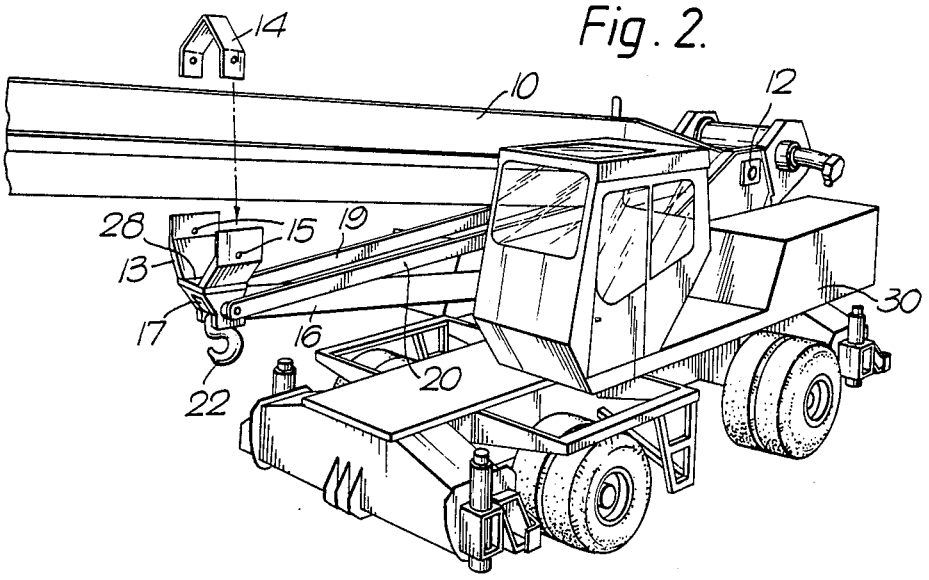
FIG. 2 is a perspective view showing a mobile crane according to the invention with the boom lifted out of its cradle to show this more clearly.
Figure 3:
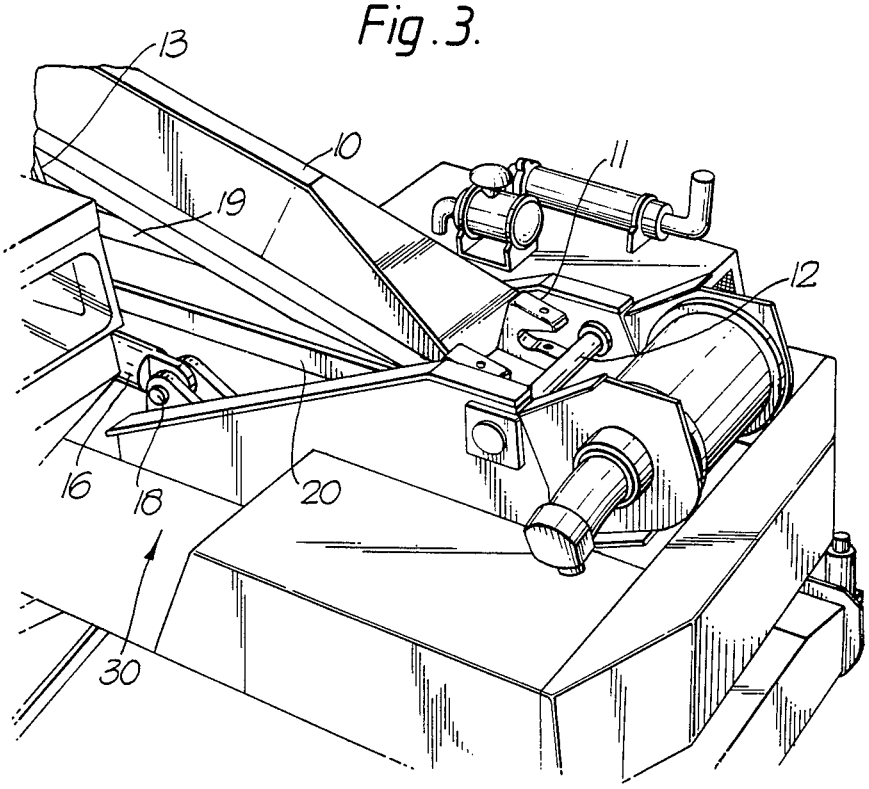
FIG. 3 is a perspective view showing the mobile crane of FIG. 2 with the boom partially withdrawn from its foot pivot to show the foot pivoting arrangement more clearly.

In FIGS. 2 and 3 there is shown a crane according to the invention in which a boom 10 having a slotted or forked foot mounting 11, is pivotally mounted on a pin 12 to the rotatable platform. The boom rests freely in a cradle 13 (FIG. 2 shows the boom lifted out of the cradle 13) and a holdfast 14 (shown removed in FIG. 2) is fixed to the cradle suitably by pins or bolts at 15 and 15' so as to hold the boom in the cradle whilst allowing it freely to slide longitudinally on the cradle.

The cradle 13 is pivotally mounted to a derricking ram 16 at point 17, the ram 16 being mounted pivotally to the crane platform 30 at 18 (see FIG. 3). Two tension links 19 and 20 extend from pivot point 17 to the boom foot pivot pin 12.

A hook 22 may be provided on the cradle at 17 to enable the crane to lift light loads when the boom is dismounted, the ram and tension links forming a derricking mechanism.

Figure 4:
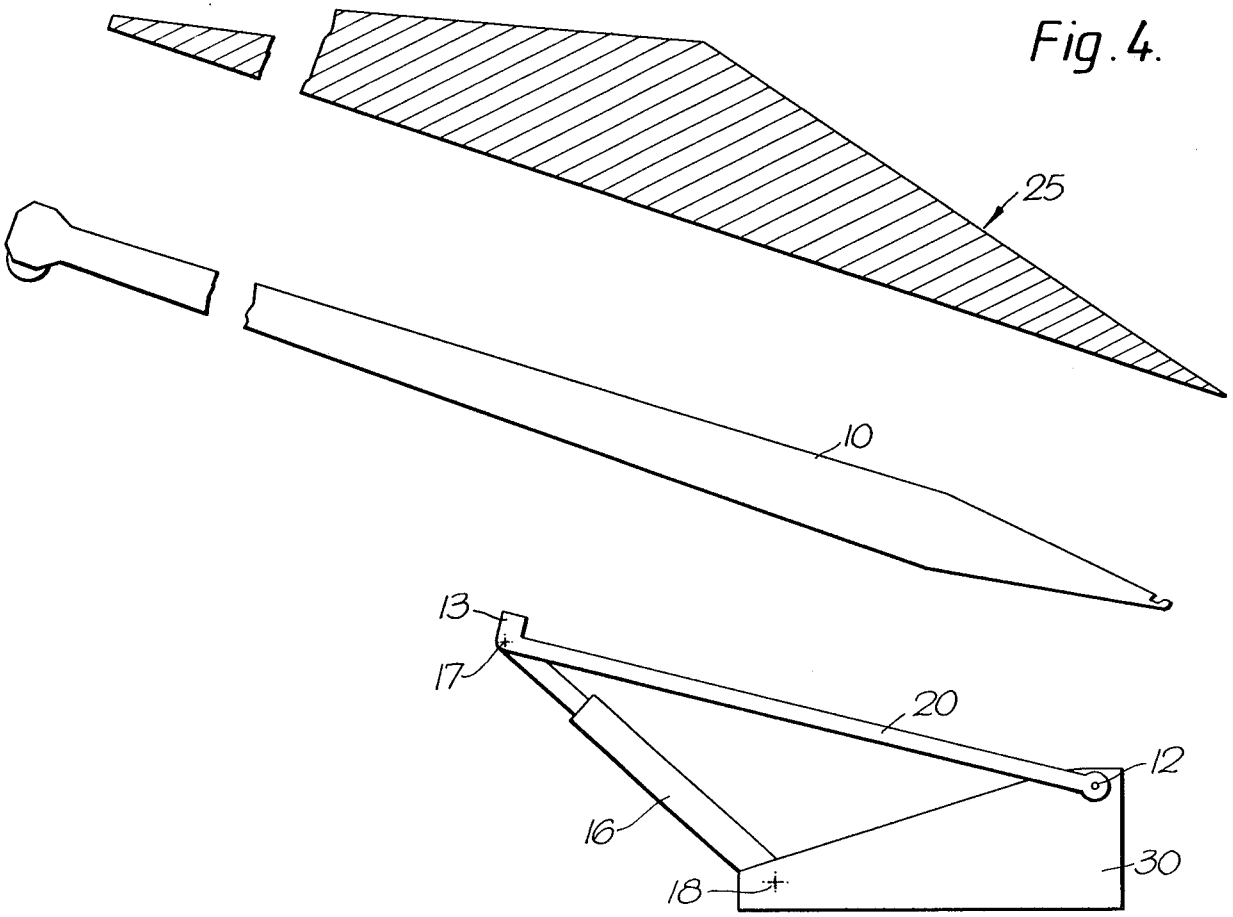
FIG. 4 is a diagrammatic side elevation of the cradling arrangements of the crane of FIG. 2 with an associated boom bending moment diagram.

In FIG. 4 a boom bending moment diagram 25 for the crane of FIG. 2 shows that no sudden change in the diagram occurs unlike that occurring in the known type of crane shown in FIG. 1.

In order to monitor boom loads a compression load cell may be provided on the cradle 13 at 28.

Figure 5:
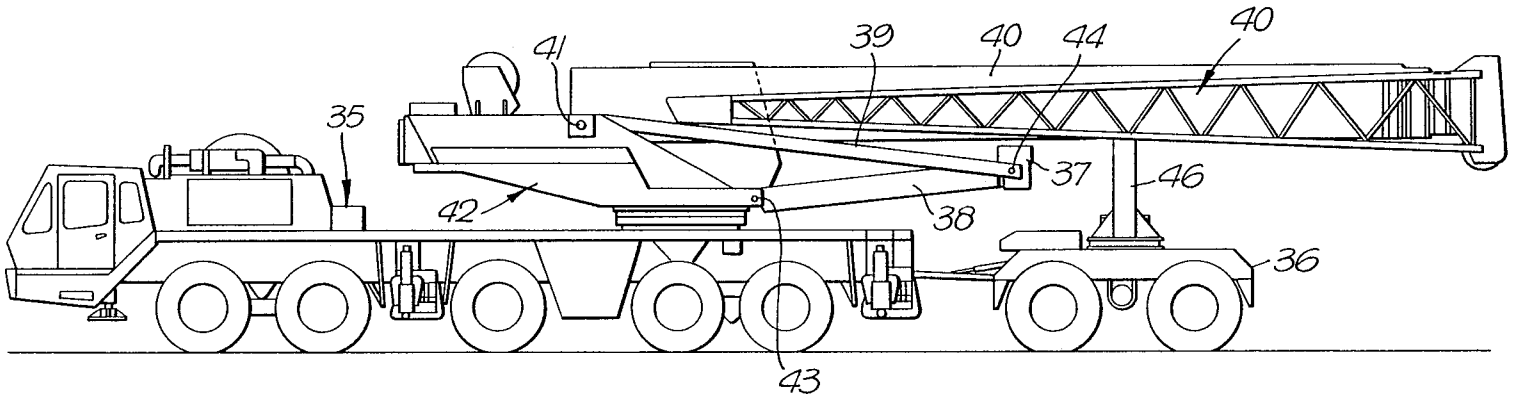
FIG. 5 is a side elevation of a further mobile crane according to the invention with the boom supported on a trailer.

In FIG. 5 a large telescoping boom mobile crane 35 according to the invention is shown which is provided with a trailer 36. The crane has a boom cradle 37 connected to a ram 38 and tension links 39, the boom 40 being pivoted at 41 to the platform 42. The ram 38 (or there can be two rams) is pivoted to the platform 42 at 43 and to the cradle at 44. In the transporting position shown in the figure the trailer has a boom support 46 which supports the boom 40 and the cradle 37 is lowered out of cradling contact with the boom so that the boom load is supported between the boom foot pivot 41 and support 46 only. This arrangement greatly reduces the wear and tear on the derricking ram or rams.

Whilst the above description is particularly relevant to cranes, apparatus in accordance with the invention may comprise access platforms, that is, aerial lifts, excavators or any other boom equipped apparatus. Hence the term "or the like" is applied to indicate such boom equipped apparatus.

The boom may be that described in detail in the specification of our co-pending U.S. application Ser. No. 409,228 corresponding to British Application No. 8125172.

I claim:

1. A lifting apparatus comprising:

a platform;

a boom having head and foot ends and being pivotally mounted to the platform at its foot end at a first pivot point on the platform;

a cradle sized to slidably support the boom;

an extendible ram pivotally mounted to the platform at its one ram end at a second pivot point on the platform and to the cradle at its other ram end at a third pivot point on the cradle;

a tension link having first and second link ends and being pivotally mounted to the platform at said first link end at a fourth pivot point on the platform and to said cradle at said second link end at a fifth pivot point on the cradle, said first and fourth pivot points being generally coincident; and a holdfast member fastened to said cradle, said cradle and holdfast member arranged and adapted to loosely surround said boom so to keep said boom from bouncing in said cradle.

2. The lifting apparatus of claim 1 wherein said platform is a mobile platform.

3. The lifting apparatus of claim 1 wherein said cradle has a generally U-shaped cross-sectional shape.

4. The lifting apparatus of claim 1 wherein said third and fifth pivot points are generally coincident.

5. The lifting apparatus of claim 1 wherein said tension link includes first and second laterally spaced apart tension links pivotally mounted to said cradle to lie on either side of said boom wherein said boom can be lowered to lie at least part way between said tension links.

6. The lifting apparatus of claim 1 further comprising a pin mounted to said platform and an open sided fork member defining a slot sized for mating engagement of said pin therein mounted to said boom, so said boom can be mounted to and dismounted from said platform via said pin and fork member slot.

7. The lifting apparatus of claim 6 including a plurality of forked members mounted to said foot end of said boom.

8. The lifting apparatus of claim 1 further comprising boom support means for supporting said boom when lowered to remove the weight of the boom from the cradle.

9. The lifting apparatus of claim 8 wherein said boom support means includes a trailer having a boom support member upon which said boom rests.

10. The lifting apparatus of claim 1 further comprising a lifting hook mounted to said cradle.

11. A lifting apparatus comprising;

a platform;

a boom having head and foot ends;

means for pivotally mounting the boom to the platform at its foot end at a first pivot point on the platform, said pivotally mounting means including a pin mounted to said platform and a plurality of open sided fork members, defining slots sized for mating engagement of said pin therein, mounted to said boom, so said boom can be mounted to and dismounted from said platform via said pin and fork member slot;

a cradle sized to slidably support the boom;

an extendible ram pivotally mounted to the platform at its one ram end at a second pivot point on the platform and to the cradle at its other ram end at a third pivot point on the cradle; and a tension link having first and second link ends and being pivotally mounted to the platform at said first link end at a fourth pivot point on the platform and to said cradle at said second link end at a fifth pivot point on the cradle, said first and fourth pivot points being generally coincident.

* * * * *